US008528132B2

(12) United States Patent
De Bock

(10) Patent No.: US 8,528,132 B2
(45) Date of Patent: Sep. 10, 2013

(54) MATTRESS CARRIER AND SUCH A MATTRESS CARRIER PROVIDED WITH MATTRESS

(76) Inventor: Frank De Bock, Rumst (BE)

( * ) Notice: Subject to any disclaimer, the term of this patent is extended or adjusted under 35 U.S.C. 154(b) by 694 days.

(21) Appl. No.: 12/519,010

(22) PCT Filed: Dec. 13, 2007

(86) PCT No.: PCT/EP2007/063918

§ 371 (c)(1),
(2), (4) Date: May 20, 2010

(87) PCT Pub. No.: WO2008/071781

PCT Pub. Date: Jun. 19, 2008

(65) Prior Publication Data

US 2010/0229302 A1 Sep. 16, 2010

(30) Foreign Application Priority Data

Dec. 13, 2006 (EP) ..... 06126061

(51) Int. Cl.
*A47C 27/00* (2006.01)

(52) U.S. Cl.
USPC ..... 5/400; 5/131

(58) Field of Classification Search
USPC ..... 5/200.1, 740, 726–727, 131, 400
See application file for complete search history.

(56) References Cited

U.S. PATENT DOCUMENTS

| | | | | |
|---|---|---|---|---|
| 5,107,558 | A | 4/1992 | Luck | |
| 7,086,108 | B1 * | 8/2006 | Litvak | 5/723 |
| 7,178,183 | B2 * | 2/2007 | Cho | 5/421 |
| 7,240,386 | B1 * | 7/2007 | McKay et al. | 5/724 |
| 7,386,903 | B2 * | 6/2008 | Hochschild | 5/740 |
| 2004/0168255 | A1 | 9/2004 | Romano et al. | |

FOREIGN PATENT DOCUMENTS

| | | | |
|---|---|---|---|
| DE | 20 2004 004 701 | U1 | 9/2004 |
| DE | 203 15 148 | U1 | 12/2004 |
| EP | 0 465 810 | A1 | 1/1992 |
| EP | 1 197 171 | A1 | 4/2002 |
| EP | 1 607 027 | A1 | 12/2005 |
| EP | 1 775 362 | A1 | 4/2007 |
| JP | 2004-097540 | A | 4/2004 |
| KR | 2002-0043482 | A | 6/2002 |
| WO | 2005/046988 | A1 | 5/2005 |
| WO | 2007/034311 | A2 | 3/2007 |

* cited by examiner

*Primary Examiner* — Frederick Conley
(74) *Attorney, Agent, or Firm* — Sughrue Mion, PLLC

(57) ABSTRACT

A mattress carrier (1) comprising a first part (3) which comprises a support surface (2) for supporting a mattress which is positioned on top of the support surface (2) and a second part (4) supporting the first part (3), the first part (3) being resilient in height direction and partially compressible when subjected to a load, characterized in that the first part (3) comprises a resilient insert (11) and in that the resilient insert (11) comprises a reversibly compressible substantially diamagnetic material which is substantially air-permeable.

27 Claims, 2 Drawing Sheets

MATTRESS CARRIER AND SUCH A MATTRESS CARRIER PROVIDED WITH MATTRESS

The present invention relates to a mattress carrier as described in the preamble of the first claim.

The present invention also relates to an assembly of such a mattress carrier provided with a mattress.

GB1525769 discloses a mattress carrier, particularly a boxspring, used to support bed mattresses. The boxspring comprises a rectangular base frame located in a bottom plane of the boxspring, a border wire delimiting a top plane and overlying the peripheral edge of the base frame and a wire grid of transverse and longitudinal wires extending between opposing sides of the border wire. A plurality of helical metal spring wires extends between the bottom plane of the base frame and the top plane delimited by the border wire. The axes of the helical metal spring wires are substantially parallel or perpendicular to the base frame and to the top plane. Each of the helical metal spring wires between the slats is unsecured and free to move both vertically and axially upon vertical loading of the boxspring.

The mattress carrier disclosed in GB1525769 however has the disadvantage that electromagnetic fields, which are ubiquitously present in today's environment in the form of for example signals for radio, GPS, GSM, WIFI, etc., are picked up, enhanced and transmitted or are even created by the plurality of metal components present in the mattress carrier. The resulting elevated electromagnetic activity present in the vicinity of the mattress carrier and therefore in the vicinity of the mattress is easily transferred to a person sleeping on the mattress, inducing sleeping trouble and creating a considerable health risk.

There is thus a need for a mattress carrier which at least comprises less metal components without deteriorating the offered support and the resilient properties for the mattress lying on top of it.

This is achieved according to the present invention with a mattress carrier showing the technical features of the characterising portion of the first claim.

Thereto, the mattress carrier of the present invention is characterised in that the first part comprises a resilient insert and in that the resilient insert comprises a reversibly compressible substantially diamagnetic material which is substantially air-permeable.

The reversibly compressible substantially diamagnetic material which is substantially air-permeable in the following will be denoted as "reversibly compressible material" without prejudice to the other characteristics of the material.

By using such reversibly compressible substantially diamagnetic material which is substantially air-permeable, it has been found that the metal components can be completely replaced by the reversibly compressible material while maintaining both resilient properties and support offered by the mattress carrier.

The inventor has in addition found that since the number of metal components is reduced, the electromagnetic fields which are picked up, enhanced and transmitted or are even created by the metal components are decreased. The person occupying the mattress is therefore shielded from electromagnetic fields. When the metal components are completely replaced by the reversibly compressible material, the electromagnetic fields present around and in the mattress carrier can be reduced to a minimum, as a consequence of which the person occupying the mattress is shielded from electromagnetic fields in an improved manner.

Besides that, the air-permeability of the material allows air currents to pass through the material and provides improved aeration as compared to conventional boxsprings. Thus an easy and permanent evacuation of for example humidity from the mattress through the mattress carrier is provided. The evacuation of humidity from the mattress carrier avoids the forming of fungus in the mattress carrier, which enhances the hygiene of the mattress carrier and keeps bad odours from forming. Moreover, since certain fungus are toxic, the sleeping conditions for a person occupying the mattress are more healthy.

It is known from the state of the art, for example from U.S. Pat. No. 5,471,725, that the coils of the boxspring mattress carrier can be enclosed in fabric pockets to guide the compression and relaxation of the springs. These pockets hinder the circulation of air through the mattress carrier and therefore hinder the abduction of humidity from the mattress carrier. Since with the present invention the number of coils may be reduced without adversely affecting the offered support, the number of pockets enclosing the coils is also reduced therefore reducing the hinder caused by the pockets and increasing the abduction of humidity from the mattress carrier.

In a preferred embodiment of the invention the resilient insert comprises at least one layer of reversibly compressible spacer fabric extending along at least part of a length, width and height of the first part, the at least one layer of spacer fabric comprising at least two spaced apart planes of fabric held together by a plurality of flexible fibres extending between the spaced apart planes of fabric.

The inventor has found that the resilient properties and the support or upward force offered by the mattress carrier are not adversely affected when at least part of the metal components are replaced by the at least one layer of spacer fabric. Apparently, the resilient properties of the spacer fabric are capable of compensating for the resiliency and support offered by the replaced metal components. Surprisingly, the metal components can even be completely replaced by the at least one layer of spacer fabric while maintaining both the desired resilient properties and support offered by the mattress carrier.

Besides that, the structure of the spacer fabric allows air currents passing through the spaced apart planes of fabric and along the flexible fibres extending between the spaced apart planes of fabric and provides improved aeration as compared to conventional boxsprings.

When using an insert comprising at least one layer of spacer fabric, the need for a layer of resilient material, such as for example latex, animal hair such as horse hair, cotton, wool of for example sheep, etc. covering the metal parts is significantly reduced. The absence of a layer covering the metal parts allows more air to pass through the mattress carrier further increasing the removal of humidity from the mattress carrier.

The resilient properties and the support offered by the mattress carrier can be adapted to meet any specific desires and/or needs for a wide range of mattresses and/or persons occupying the mattress by for example using several spacer fabrics, possibly having different dimensions and/or geometries, located at a different position in the length, width and/or height direction of the first part of the mattress carrier from which all or some portray a different resiliency and/or offer a different support which depends on, for example, the flexibility of the fibres, the density of fibres extending between the two spaced apart planes, the length of the flexible fibres, the properties of the fabric of the spaced apart planes, the height between the spaced apart planes, etc.

A preferred embodiment of this invention is characterised in that the resilient insert comprises a coil of a plastic material, which coil comprises a volume delimited by a circumferential wall, which extends mainly in height direction of the mattress carrier and comprises a plurality of piled and mutually connected bulges, at least one of the bulges comprising an outlet to permit air contained in the mattress carrier to be displaced into and from the volume of the coil.

Preferably, the bottom and top of the coil is open to increase the possibility of air to pass though the coil.

This coil of plastic material offers a good elastic support for a person occupying the mattress while allowing air to circulate through the mattress carrier. The coil however, since it is made of plastic, does not pick up electromagnetic fields, shielding the person occupying the mattress from these electromagnetic fields.

A preferred embodiment of this invention is characterised in that the insert is removably mounted within the first part. This presents the additional advantage that the mattress carrier can be easily decomposed and that the reversibly compressible material can be easily cleaned, for example by washing in for example a domestic washing machine. This improves hygiene, counteracts house dust mite and avoids allergic reactions.

Another preferred embodiment of the invention is characterised in that the first part comprises at least two zones in the length direction of the first part, the zones being provided to support different parts of the body of a person occupying the mattress, each zone having different resilient properties and offering a different support and at least one zone comprising at least one insert. By adapting the nature of at least one insert, the resiliency and support offered by it may be adapted to the load to which it is subjected. The mattress carrier therefore allows fine tuning of the resilient properties and the support offered by the mattress carrier taking the varying weight of different body parts into account.

Yet another preferred embodiment of the invention is characterised in that the first part comprises at least two zones in the width direction of the first part, each zone being provided to support a different person occupying the mattress, each zone having different resilient properties and offering a different support and at least one zone comprising at least one insert. The mattress carrier therefore allows fine tuning of the resilient properties and the support offered by the mattress carrier taking the varying needs and desires of different persons sleeping on a single mattress carrier into account.

The invention also relates to an assembly of a mattress carrier according to the invention and a mattress delimited by an upper wall providing a resting surface, a lower wall providing a support surface supported by the support surface of the mattress carrier and a plurality of side walls, the mattress, at least over part of its resting surface, comprising a reversibly compressible substantially diamagnetic material which is substantially air-permeable.

Such a mattress is already known from patent application EP-A2-1 576 908. The mattress according to EP-A2-1 576 908 could however only be provided on top of conventional mattress carriers, such as the mattress carriers described in the state of the art mentioned above. As described above, the mattress carriers of the state of the art do not sufficiently allow air to pass so that for example humidity cannot easily be abducted. A mattress carrier covers a substantial part of the support surface of the mattress, decreasing a substantial part of the total area of the mattress available for allowing air to pass. When providing such a mattress carrier with for example a mattress according to EP-A2-1 576 908 the increased ability of the mattress to allow air to pass through the mattress and hence to abduct humidity from the mattress, is significantly reduced since it is hampered by the mattress carrier covering the support surface of the mattress. Therefore, although the mattress from EP-A2-1 576 908 has an increased aeration, this ability is significantly hampered by the mattress carriers of the state of the art and the aeration of the assembly of the mattress and the mattress carrier is insufficient.

Known mattress carriers moreover comprise metal elements so that electromagnetic fields are picked up, enhanced and transmitted or are even created by the plurality of metal elements in the mattress carrier, as discussed earlier on. Therefore in an assembly of a mattress as disclosed in EP-A2-1 576 908 with a known mattress carrier, although the mattress is provided not to pick up electromagnetic fields, electromagnetic fields are still picked up by the mattress carrier as described earlier on, resulting in a considerable health risk for the person occupying the mattress.

The inventor has found that by combining a mattress delimited by an upper wall providing a resting surface, a lower wall providing a support surface and a plurality of side walls, the mattress, at least over part of its resting surface, comprising a reversibly compressible substantially diamagnetic material which is substantially air-permeable, with the mattress carrier according to the invention, the aeration of the assembly is significantly increased. As explained earlier on, the mattress carrier according to the invention has increased aeration abilities, due to the presence of the above-mentioned reversibly compressible material, which significantly improves the aeration of the mattress carrier according to the invention. Since, in general, a significant part of the support surface of the mattress is supported by the support surface of the mattress carrier, having an improved aeration, passage of air through the support surfaces of the mattress and the mattress carrier is improved and the assembly of the mattress and the mattress carrier obtains significantly improved aeration properties. In other words, the individual aeration properties of each member of the assembly of the mattress and the mattress carrier is improved by the aeration properties of the other so that the whole of the assembly has aeration properties which is far superior to the sum of the individual aeration properties of the members of the assembly.

The inventor has moreover found that the assembly according to the invention also has a superior ability to remove humidity, such as transpiration of the person occupying the mattress, away from the person occupying the mattress and/or the resting surface of the mattress. This way the resting surface is kept dry and the comfort for the person occupying the mattress is even further increased. The removal of humidity from the mattress carrier moreover avoids fungus to form in the mattress carrier, which enhances the hygiene of the mattress carrier and avoids bad odours. Moreover, since fungus can be toxic, the sleeping conditions for a person occupying the mattress are more healthy.

The assembly according to the invention also allows to reduce the number of metal components so that the electromagnetic fields created by the metal components is decreased. When the metal components of the mattress and the mattress carrier of the assembly according to the invention are completely replaced by the reversibly compressible material, the electromagnetic fields around the assembly according to the invention can be reduced to a minimum.

In a preferred embodiment of the assembly according to the invention, the mattress carrier of the assembly comprises a heater for providing warm air from beneath the support surface to at least part of the support surface.

Such a heater provides warm air to the support surface since the warm air can rise up through the mattress carrier because of the improved aeration possibilities of the mattress carrier. If such a mattress carrier is used in an assembly according to the invention, due to the aeration possibilities of the mattress, the warm air can subsequently rise up through the mattress due to for example convection. The warm air can therefore warm up the resting surface of the mattress thus providing optimal conditions for a person to sleep. The heater also increases the abduction of humidity from the assembly. Moreover, the free circulation of warm air through the mattress carrier does not require a ventilator. Therefore noise from a ventilator circulating air through the mattress carrier is avoided.

In a preferred embodiment, the assembly is characterised in that the mattress comprises a coil of a plastic material, which coil comprises a volume delimited by a wall, wherein the wall extends mainly in height direction of the mattress and comprises a plurality of piled and mutually connected bulges, at least one of the bulges comprising an outlet to permit air contained in the mattress to be displaced into and from the volume of the coil.

As discussed earlier on for the mattress carrier, these coils allow air to circulate through the mattress of the assembly while offering a good support and shielding the person occupying the mattress from electromagnetic fields.

In a preferred embodiment, the assembly is characterised in that the mattress comprises a layer of spacer fabric.

Such a layer of spacer fabric offers good aeration of the mattress of the assembly, as discussed earlier for the mattress carrier, offers a good support to a person occupying the mattress and does not pick up electromagnetic radiation.

In a preferred embodiment, the assembly is characterised in that the mattress comprises a combination of two distinct layers, superimposed in the thickness direction of the mattress, whereby the upper layer of the combination is a first support layer of first soft material, and the lower layer of the combination is the layer of spacer fabric.

The inventor has now surprisingly found that by incorporating the spacer fabric into a mattress, in combination with at least one additional support layer of a soft material, a mattress according to the invention is obtained having the desired resting comfort, as well as an improved aeration, in comparison to the known mattress. More in particular, it has been found that it is now possible to incorporate spacer fabrics with increased thickness into the mattress, without having the risk for substantial fibre buckling while still retaining improved aeration.

Surprisingly also, the point elasticity of the mattress is improved over known mattresses, such as for example inner spring mattresses with or without pocket springs.

In the context of this application an improved point elasticity means that the elastic counter force experienced by the body of a person resting on the mattress is well distributed over the contact surface between the body and the mattress upper wall.

According to the invention it is possible to incorporate the combination of the two distinct layers into the mattress over part of the surface of the mattress only. This may be done to obtain the desired beneficial effect only over those parts of the mattress where it is most needed, such as for instance in the vicinity of the back or the hips. Especially for patients which have to rest onto a mattress for extended periods of time, long resting periods can have a detrimental effect on their skins. They may for instance develop open wounds. By applying the combination of the invention at those critical parts of the mattress, these problems may be avoided. Also, by incorporating the combination of the two distinct layers into the mattress over part of the surface of the mattress only, significant cost savings can be obtained.

In a more preferred embodiment, the assembly is characterised in that it moreover comprises a second support layer of second soft material, extending at least over part of its resting surface and directly below the combination.

In this preferred embodiment, the spacer fabric is protected from damage by a support layer of soft material on its upper surface, and by a support layer of soft material on its lower surface, thereby forming a sandwich structure with two skin layers of soft material at both side surfaces, and in between them a spacer fabric.

Preferably, the mattress according to the invention comprises, extending substantially over its whole surface, said combination of two distinct layers positioned on top of said second support layer of second soft material.

In this way, the desired comfort and aeration effect is readily achieved over the entire surface of the mattress, which improves this effect. Moreover, the mattress of the invention can be produced in an economical way, with a minimum of time-consuming hand labour.

The soft material of the support layers can be any suitable material known in the art. Suitable soft materials may for instance comprise wool, cotton, eventually unbleached, hemp, natural latex, silk, cashmere, hand teased hair, spacer fabric and so on. Preferably the soft materials comprise foamed materials. Suitable foamed materials are for instance polyurethane and/or rubber latex foams. It is also possible to use polyether foams. In principle foams with any hardness can be used. The hardness and/or elasticity of the foamed materials used can be chosen according to the desired personal comfort levels. Hardness and/or elasticity can be chosen according to principles, well known to the person skilled in the art. It is for instance possible to vary hardness and/or elasticity by choosing a particular material for the foam, or by choosing the specific construction of the foam. Suitable foam constructions include closed cell foams, open cell foams, syntactic foams consisting substantially of polymeric or other suitable material beads, embedded and glued together by a suitable adhesive, and so called viscoelastic foams.

A particularly preferred embodiment according to the invention is a mattress, characterised in that the second foamed material is a viscoelastic foamed material.

Viscoelastic foams suitable for the mattress of the invention are for example marketed under the registered tradename Tempur®, or are viscoelastic foams obtainable from the company Eupenfoam under the registered tradename Eucatherm®. These materials are essentially foams made of a viscoelastic polymer with relaxation times which may even range in the order of minutes. Such a foam responds to the body as follows. In an unslept bed, the foam has essentially acquired room temperature. At this temperature its relaxation times may be as long as several minutes, especially in winter time when room temperatures are low. When applying the pressure of the body to the foam, it will initially feel hard, since it can not relax quickly enough to adapt to the shape of the body. However aided by the temperature rise of the body contact, the viscoelastic foam will relax and gradually adapt its shape to the shape of the body parts resting on it. This will provide an almost exact copy of the body shape and therefore a well divided supporting pressure. This will enhance the feeling of comfort of a person resting on such a foam.

Applicant has surprisingly found that the combination of the invention comprising a spacer fabric and an upper layer of a viscoelastic foam enhances this effect.

Preferably the mattress according to the invention comprises first and/or second foamed material with an open cell structure. This further improves the dehydration and aeration of the mattress. Moreover the mattress according to this preferred embodiment can be cleaned very easily and thoroughly, which is a great advantage for persons allergic to for instance dust mite.

Most preferably the mattress according to the invention comprises reticulated foam material, as reticulated foamed materials have superior aerating properties.

The invention is further elucidated in the figures attached to the present application and the figure description below.

Figure 1:
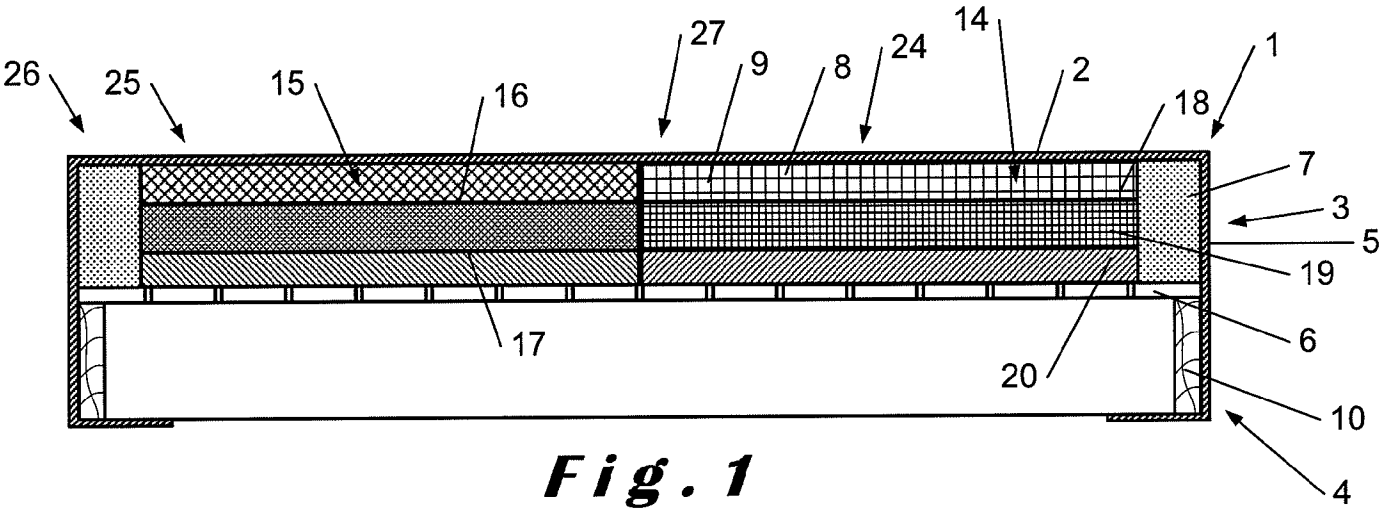
FIG. 1 shows a cross-section of the mattress carrier according to the invention along a width direction of the mattress carrier.

The mattress carrier 1 according to the invention comprises a first part 3 which comprises a support face 2 for supporting a mattress 28 which is positioned on top of the support surface 2 with a lower wall 31 providing a support surface supported by the support surface 2 of the mattress carrier 1. The mattress carrier 1 comprises a second part 4 supporting the first part 3. The support surface 2 can be adapted to support any type of mattress 28 known to the person skilled in the art such as round, oval, rectangular, heart-shaped, . . . mattresses 28 or twin, single, queen-sized, king-sized, . . . mattresses 28. Preferably, the dimensions and shape of the support surface 2 are adapted to the dimensions and shape of the mattress 28 positioned on top of the support surface 2. For example, a rectangular supporting surface 2 is preferably used for supporting a twin rectangular mattress 28. In this embodiment, the rectangular support surface 2 preferably is large enough to support the mattress 28 positioned on top of the support surface 2. Preferably, the entire surface of the mattress 28 positioned on the support surface 2 is supported by the support surface 2. This is however not critical to the invention and the support of the support surface 2 to the mattress 28 can be determined by the person skilled in the art and the mattress 28 can be only partly supported by the support surface 2. The dimensions and shape of support surfaces 2 for the mattresses 28 for alternative dimensions and shapes can be determined by the person skilled in the art and are not critical to the invention.

The support surface 2 preferably is substantially flat, providing a flat support for the mattress 28. The support surface 2 may however also be bent providing the mattress 28 with a non-planar support surface 2. The thus created curves of the support surface 2 may be adapted to the desires of a person lying on top of the mattress 28. For example, the feet and leg area of the person lying on top of the mattress 28 may be elevated with respect to the pelvis region, the knee region may be elevated with respect to the pelvis and feet region, the pelvis region may be lowered with respect to the back and upper leg region, the back region may be elevated with respect to the pelvis and upper leg region, etc. The curves of the support surface 2 preferably are individually adaptable to the different persons lying on top of the mattress 28 so that when for example two persons occupy the mattress 28, the support surface 2 can be bent to the desired position of the mattress 28 for each of the persons individually. The curves of the support surface 2 may be permanently present but preferably can be adapted by the person(s) lying on top of the mattress 28. The mattress carrier 1 thereto preferably comprises means for bending the support surface 2, therefore adapting the curves in the support surface 2. The means for bending the support surface 2 preferably also comprise means for altering the height of the support surface 2 with respect to the floor according to the desires of the person(s) occupying the mattress 28. Since these means are known to the person skilled in the art these means can be chosen by the person skilled in the art and are not critical to the invention.

The support surface 2 can be covered by any material known to the person skilled in the art such as for example knitted, braided, woven and/or non-woven fabric, plastic, etc. The material used to cover the support surface 2 is not critical to the invention and can be determined by the person skilled in the art. Preferable, the support surface 2 is covered with a material allowing an easy passage of air.

The first part 3 of the mattress carrier 1 is resilient in height direction and partially compressible when subjected to a load. The first part 3 preferably is delimited by a plurality of upright circumferential walls 5 which more preferably run substantially perpendicular to the support surface 2. The first part 3 however can be delimited by any other means known to the person skilled in the art.

Figure 2:
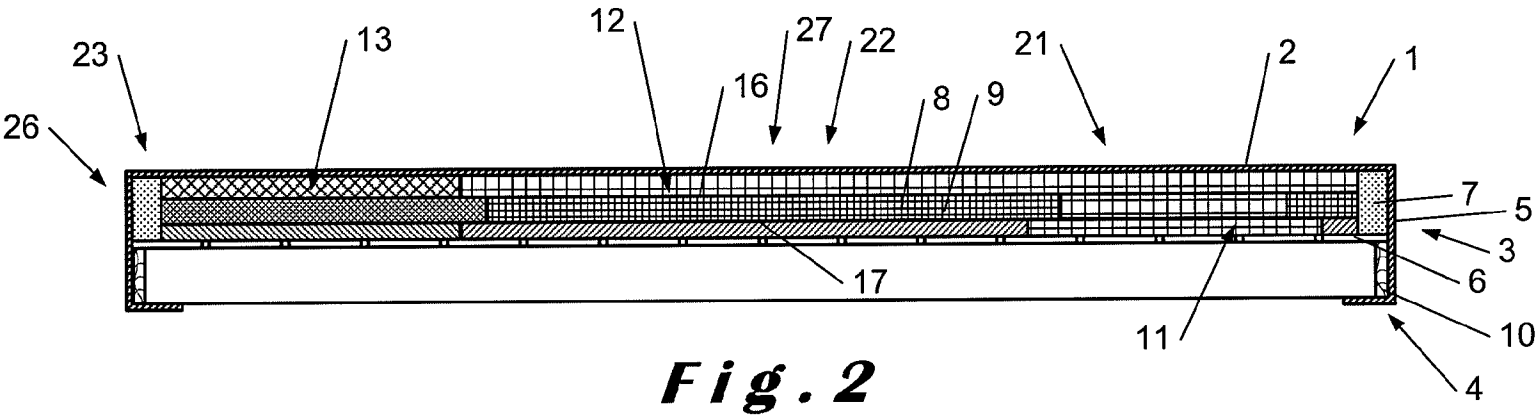
FIG. 2 shows a cross-section of the mattress carrier according to the invention along a length direction of the mattress carrier.

The circumferential walls 5 of the first part 3 preferably are covered by a material which can be made of any material known to the person skilled in the art such as for example knitted, braided, woven and/or non-woven fabric, plastic, etc. The material used to cover the walls 5 is not critical to the invention and can be determined by the person skilled in the art but preferably the material covering the support surface extends over the walls 5 as can be seen in FIGS. 1 and 2.

The material covering the different parts of the mattress carrier 1 preferably are easily removable from the rest of the mattress carrier 1 to allow an easy access to the inner materials of the mattress carrier 1, for example for replacing, repairing or cleaning. The material covering the different parts of the mattress carrier 1 can for example thereto be provided with zippers, hook-and-loop fasteners, buttons, etc.

The first part 3 comprises at least one resilient insert 11. The resilient insert 11 can comprise at least one layer 18 of reversibly compressible spacer fabric 9 extending along at least part of a length, width and height of the first part 3. The at least one layer 18 of spacer fabric 9 comprises at least two spaced apart planes 16, 17 of fabric held together by a plurality of flexible fibres 8 extending between the spaced apart planes 16, 17 of fabric.

The number of spaced apart planes 16, 17 partly determines the resilient properties of the layer 18 of spacer fabric 9 but is not critical to the invention and can be determined by the person skilled in the art.

The spaced apart planes 16, 17 preferably are substantially flat but may comprise elevations and lowerings to provide specific desired resilient properties. The two planes 16, 17 preferably are substantially parallel to each other providing a substantially uniform height between the two spaced apart planes 16, 17. It is however possible to bend the planes 16, 17 over some angle to provide a curved layer 18 of spacer fabric 9 according to the desires of the person lying on top of the mattress.

The fabric of the spaced apart planes 16, 17 can be any fabric known to the person skilled in the art but preferably is knitted, braided, woven and/or non-woven fabric. The fabric of the spaced apart planes 16, 17 partially determines the resilient properties of the layer 18 of spacer fabric 9.

The fabric of the spaced apart planes 16, 17 preferably comprises a structure which comprises openings which more preferably are polygonical, rectangular, square, diamond-shaped, hexagonal, etc. The structure of the spaced apart planes 16, 17 is not critical to the invention and can be determined by the person skilled in the art. The structure can for example be honey grate shaped. The dimensions and shape of the openings can be determined by the person skilled in the art and partially determine the resilient properties of the layer 18 of spacer fabric 9.

The structure of the first plane 16 may be shifted with respect to the structure of the second plane 17. This however can be determined by the person skilled in the art and partially determines the resilient properties of the layer 18 of spacer fabric 9.

In between the spaced apart planes 16, 17 a plurality of fibres 8 are provided which bridge the distance between the different spaced apart planes 16, 17. The bridging fibres 8 preferably are integral to the fabric of the planes 16, 17. For example, a fibre 8 of a first plane 16 at some point leaves the fabric of the first plane 16, bridges the distance between the spaced apart planes 16, 17 and re-enters an opposing second plane 17. This is easily achieved by a person skilled in the art of textile techniques. The fibres 8 extend between the spaced apart planes 16, 17 substantially straight. By this is meant that the fibres 8 are preferably not extensively curled on themselves but cross the distance along a relatively short path. It does not mean that fibres 8 may not show a curvature. The fibres 8 may cross each other at some angle, however they may also run more or less parallel to each other preferably substantially parallel to the spaced apart planes 16, 17. The average direction of the bridging fibres 8 may differ along the distance between the spaced apart planes 16, 17, may differ in the length direction from that in the width direction, may differ along the length direction and/or may differ along the width direction of the resilient insert 11.

The fibre density of the fibres 8 can be chosen by the person skilled in the art, depending on the desired resilient properties of the spacer fabric 9. Preferred densities are between 10 and 1500 fibres 8 per $cm^2$. More preferred densities are between 50 and 200, between 80 and 300 or between 100 and 400 fibres 8 per $cm^2$. Preferred densities are for example 125; 190 or 250 fibres 8 per $cm^2$. These values of the density are however not critical for the invention.

Layers 18 of spacer fabrics 9 made from all fibres 8 known in the art can be used. Although it is possible to use metallic fibres 8, if desired, preferred fibres 8 are natural, such as cotton for instance, and/or organic fibres 8. Organic fibres 8 are preferably used since interference with electromagnetic waves is negligible. Preferred organic fibres 8 include polyester, polyalkylene, such as polyethylene and polypropylene, and/or polyamid fibres 8. It is also possible to use elastic fibres 8. It is likewise possible to add specific additives to the fibre material, such as for instance flame retardants, antibacterial, colouring and/or anti-odorous additives. The fibres 8 can be mono- and/or multifilament, and may be textured.

The number of fibres 8, the direction of the fibres 8, the distance between the spaced apart planes 16, 17, the angle of the crossing of the fibres 8, the length of the fibres 8, the thickness of the fibres 8, the curvature of the fibres 8 and the material of the fibres 8 partially determine the resilient properties of the layer 18 of spacer fabric 9. The resilient properties of the layer 18 of spacer fabric 9 can be anisotropic. The resilient properties in other words can be different in length direction (in a plane substantially parallel to the spaced apart planes 16, 17), in width direction (in a plane substantially parallel to the spaced apart planes 16, 17) and in an upwards direction. The resilient properties of the layer 18 of spacer fabric 9 can be chosen in function of the desired resilient properties of the resilient insert 11 by the person skilled in the art as will be discussed further on.

In a preferred embodiment of the mattress carrier 1 according to the invention, the spaced apart planes 16, 17 preferably run substantially parallel to the supporting surface 2 and the fibres 8 extend substantially upwards with respect to the support surface 2 of the mattress. The fibres 8 then to great extend determine the resilient properties of the resilient insert 11.

The layer 18 of spacer fabric 9 provides substantially higher volume than any comparable standard compound fabric (bonded fabrics), and thus an additional padding effect further improving sleeping comfort. It moreover has better respiratory activity than any comparative standard double fabrics due to its extremely high air permeability. Moreover the balanced thermal insulation behaviour supports comfortable sleeping temperature. The spacer fabric 9 reacts to any type of load and weight with particular high compression elasticity. After load changes, the fabric immediately regains its original position. The sleeper will benefit from this with a much more comfortable position. The compression elasticity feature equally boosts humidity transport and respiratory activity.

The resilient properties of the resilient insert 11 at least partly depend from the resilient properties of the at least one layer 18 of spacer fabric 9 comprised in it and can be adapted to the desired resilient properties of the mattress carrier 1 by adapting the resilient properties of the at least one layer 18 of spacer fabric 9 and/or by adding more layers 18, 19, 20 of spacer fabric 9 to the resilient insert 11. The different layers of spacer fabric 9 may all have different orientations but preferably all layers of spacer fabric 9 are positioned so that their spaced apart planes 16, 17 are parallel to the support surface 2.

The different layers 18, 19, 20 of spacer fabric 9 can be positioned on top of each other such as layers 18, 19 and 20, adjoining in length direction of the first part 3 and/or adjoining in width direction of the first part 3. The resilient insert 11 can for example comprise several layers 18 of spacer fabric 9 positioned next to each other in length and width direction of the first part 3 whereupon several layers of spacer fabric 9 are positioned lying next to each other in length and width direction of the first part 1 possibly overlapping several underlying layers of spacer fabric 9 as can be seen in FIG. 2. By combining several layers of spacer fabric 9 in one resilient insert 11, possibly having different resilient properties, the resilient properties of the resilient insert 11 can be adapted to the desired resilient properties of the mattress carrier 1 as a whole. The resilient properties of the resilient insert 11 can be homogeneous over the length and width of the resilient insert 11 or can vary locally in width and/or length direction of the resilient insert 11. The position of the different layers of spacer fabric 9 and the resilient properties of the different layers of spacer fabric 9 in the resilient insert 11 can be determined by the person skilled in the art depending on the desired resilient properties of the mattress carrier 1.

Preferably, a substantial part of the support surface 2 is situated above the resilient insert 11, therefore providing as much of the support surface 2 with the benefits of the layers 18 of spacer fabric 9. This is however not critical to the invention and only a part of the support surface 2 may be situated above a resilient insert 11 which is embedded into the mattress carrier 5. The first part 3 may also comprise several resilient inserts 11 embedded on for example different locations in the first part 3. The position of the resilient insert(s) 11 depends on the desired resilient properties of the support surface 2 and of the mattress carrier 1.

Figure 4:
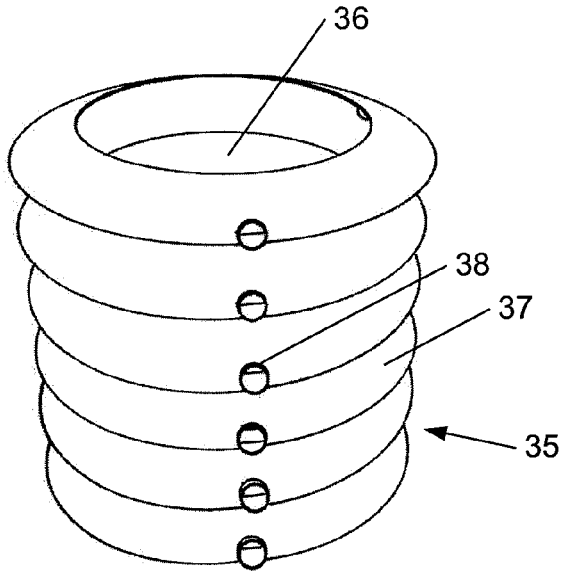
FIG. 4 shows a coil which can be used in the mattress carrier according to the invention or in the mattress of the assembly according to the invention.

The resilient insert 11 can in addition to the layer(s) of spacer fabric 9 or replacing the layer(s) of spacer fabric 9 comprise a coil 35, shown in FIG. 4, of a plastic material, which coil 35 comprises a volume 36 delimited by a wall, wherein the wall extends mainly in height direction of the mattress carrier 1 and comprises a plurality of piled and mutually connected bulges 37, at least one of the bulges 37 comprising an outlet 38 to permit air contained in the mattress carrier 1 to be displaced into and from the volume of the coil 35.

In a first preferred embodiment of the mattress carrier 1 according to the invention, the first part 3 comprises a single resilient insert 11 extending below a substantial part of the support surface 2 of the mattress carrier 1. The resilient insert 11 preferably is shaped according to the shape of the mattress carrier 1 such as oval, round, rectangular, square, heart-shaped, etc. and supports the mattress as much as possible.

In a second preferred embodiment of the mattress carrier 1 according to the invention, the first part 3 comprises at least two zones 21, 22 in the length direction of the first part 3. The zones 21, 22 are subjected to the load of different parts of the body of a person occupying the mattress, each zone 21, 22 having different resilient properties and offering a different support. At least one zone 21, 22 comprises at least one insert 11, 12. Preferably, each zone 21, 22 comprises a resilient insert 11, 12. The first zone 21 therefore comprises a first resilient insert 11 and the second zone 22 comprises a second resilient insert 12. More preferably, the first part 3 comprises at least three zones 21, 22, 23 in length direction of the first part 3. The third zone 23 preferably comprises a third resilient insert 13. The three zones 21, 22, 23 can be seen in FIG. 2. A first zone 21 is subjected to the load of the head and shoulder part of the person occupying the mattress, the second zone 22 is subjected to the load of the hip and back part of the person occupying the mattress and a third zone 23 is subjected to the load of the leg part of the person occupying the mattress. The resiliency of the three zones 21, 22, 23 preferably are adapted to their supportive function, the body parts which they receive and the desires of the person(s) occupying the mattress.

As can be seen on FIG. 2, the second 12 and the third 13 of the respective second 22 and third 23 zone preferably each comprise three layers of spacer fabric 9 positioned on top of each other. Each layer has its characteristic resilient properties and the combination of the resilient properties of the layers give the second and third inserts 12, 13 the desired resiliency. The first insert 11 comprises two layers of spacer fabric 9 positioned on top of each other. Part of the second insert 12 covers the first insert 11 resulting in the desired resilient properties of the first zone 21. The first insert 11 also comprises two layers of spacer fabric 9 positioned next to each other in length direction of the first part 3 partly covering other layers of spacer fabric 9 of the first insert 11. The combination of the different layers of spacer fabric 9 in the first insert 11 and the combination of the first 11, second 12 and third 13 insert provides the first part 3 with the specific resilient properties desired by the person(s) occupying the mattress and/or provides the different body parts with the right support.

Even more preferably, the first part 3 comprises at least two zones 24, 25 in the width direction of the first part 3. Each zone 24, 25 is subjected to the load of a different person occupying the mattress. Each zone 24, 25 has different resilient properties and offers a different support. At least one zone 24, 25 comprises at least one insert 14, 15. Preferably, each zone 24, 25 comprises an insert 14, 15. The zones 24, 25 of FIG. 1 each comprise three layers 18, 19, 20 of spacer fabric positioned on top of each other. Most preferably, the 6 different zones, two times three zones, each comprise at least one resilient insert 11 as indicated in FIGS. 1 and 2. By combining several adjacent and/or overlapping resilient inserts 11 and/or layers of spacer fabric 9, as indicated on FIGS. 1 and 2, a gradual change of resilient properties of the support surface 2 and of the mattress carrier 1 can be obtained.

The resilient insert 11, preferably is removably mounted into the mattress carrier 1. The resilient insert 11 can therefore be removed from the mattress carrier 1 to replace, repair and/or wash it. The possibility of washing the resilient insert 11 adds to the hygienic properties of the mattress carrier 1.

In a preferred embodiment of the mattress carrier 1 according to the invention, the first part 3 comprises a resilient material 7 at least partially surrounding the resilient insert 11 giving the mattress carrier 1 specific resilient properties near the edge 26 for example to offer a more rigid or resilient edge 26 along the walls 5 of the mattress carrier 1 to offer a comfortable sitting place which for example allows a person to more easily leave the bed. This is particularly important when making mattress carriers 1 for older and/or physically challenged people. The resilient material preferably extends along the entire edge 26 of the mattress carrier 1. The resilient material 7 preferably comprises foamed rubber. The material for the resilient material 7 can however be chosen by the person skilled in the art and is not critical to the invention.

At least one edge 26 surrounding the first part 3 preferably is elevated with respect to a central part 27 of the first part 3 providing a place for even more easily leaving the bed and/or better positioning the mattress on top of the mattress carrier 1.

The second part 4 supporting the first part 3 can have any form shape deemed appropriate by the person skilled in the art such as oval, round, rectangular, square but preferably has the same shape as the first part 3. The second part 4 can have any dimensions deemed appropriate by the person skilled in the art but preferably has at least the same dimensions as the first part 3, more preferably the second part 4 has the same dimensions as the first part 3.

The second part 4 preferably comprises a perforated board 6 supporting the first part 3. The perforated board 6 can be made of any material known to the person skilled in the art but preferably is made from a diamagnetic material such as wood, plastic or any other material known to the person skilled in the art. The perforated board allows air to pass, therefore improving the abduction of humidity in the mattress carrier 1.

The resilient properties of the mattress carrier 1 may depend from different parameters such as height of the walls delimiting the support surface 2, material of the support surface 2, the material of the walls delimiting the support surface 2, the load to which it is subjected, the resilient properties of the resilient inserts 11, resilient properties of the perforated board 6, etc. The different parameters can be chosen in function of each other and the desired resilient properties of the mattress carrier 1 by the person skilled in the art.

The second part 4 of the mattress carrier 1 preferably comprises a frame 10 supporting the perforated board 6 supporting the first part 3. The shape and dimensions are not critical to the invention and can be determined by the person skilled in the art. The material of the frame can be any material known to the person skilled in the art such as wood, metal, plastic, etc.

The second part 4 preferably can be covered with any material known to the person skilled in the art but preferably is covered with the same material covering the support surface 2 and the walls 5 as indicated on FIGS. 1 and 2.

In another preferred embodiment of the mattress carrier 1 according to the invention the mattress carrier 1 comprises means for heating the support surface 2, therefore warming the mattress positioned on top of it.

More preferably, the heating means comprise a heater for providing warmth from beneath the support surface 2 to at least part of the support surface 2. The heater preferably is positioned below the reversibly compressible material of the resilient insert 11. This has the advantage that no outlet opening has to be provided in the support surface 2 of the mattress carrier 1 for allowing warmth to reach the support surface 2 since the reversibly compressible improves the ability to allow easy passage of air and therefore warmth. The entire support surface 2 of the mattress carrier 1 can therefore be adapted to resiliently receive a mattress 28 without having to take into account that an outlet opening for the heater is needed.

More preferably, the heater is provided to provide warm air from beneath the support surface 2 to at least part of the support surface 2. The heater thereto preferably is mounted below the reversibly compressible material so that the warm air can rise through the reversibly compressible material up to the support surface 2 of the mattress carrier 1. The warm air provided by the heater is then easily transported through the reversibly compressible material since that material allows an easy passage of air.

Preferably, the heater is provided near the bottom of the mattress carrier 1, preferably on top of the board 6. When the second part 4 of the mattress carrier 1 is provided for allowing air to pass, for example by a perforated board 6, the heater can also be provided under the second part 4, for example under the perforated board 6.

The heater can be any heater known to the person skilled in the art such as for example an infrared heater.

Figure 3:
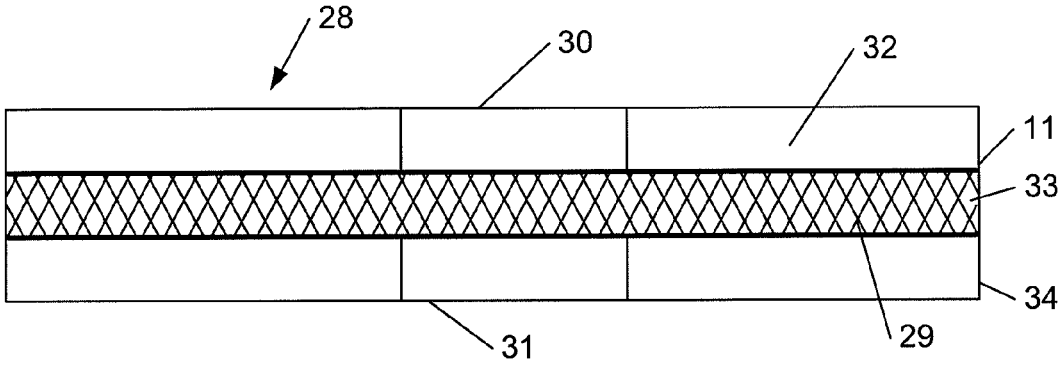
FIG. 3 is a schematic view of a preferred embodiment of the mattress used in the assembly of the mattress carrier according to the invention, along a lengthwise cross section.

A cross-section of the mattress 28 for the assembly according to the invention is shown in FIG. 3. The mattress 28 preferably comprises an envelope for the content of the mattress 28, having an upper wall 30 providing a resting surface, a lower wall 31 providing a support surface to the mattress 28, and four side walls, being one at the foot end, one at the head end, a left side, and a right side.

The mattress 28 comprises, at least over part of its resting surface, a reversibly compressible substantially diamagnetic material which is substantially air-permeable.

As can be seen from FIG. 3, the cross section is build up of the envelope sides (upper wall 30, lower wall 31, left side, and right side), which encloses the reversibly compressible material. Such an envelop is not critical for the invention and the content of the envelop can also be provided to the mattress carrier 1 without envelop. The envelop preferably is removable so that the reversibly compressible material can be accessed for repairing, cleaning, replacing, etc.

Preferably, the reversibly compressible material extends over the entire width of the mattress. More preferably, the reversibly compressible material also extends over the entire length of the mattress 28. The reversibly compressible material thus substantially extends over the resting surface so that the aeration possibilities of the mattress 28 are maximized.

The reversibly compressible material can for example be a layer of spacer fabric 29 or a coil 35 of a plastic material, which coil 35 comprises a volume 36 delimited by a wall, wherein the wall extends mainly in height direction of the mattress 28 and comprises a plurality of piled and mutually connected bulges 37, at least one of the bulges 37 comprising an outlet 38 to permit air contained in the mattress 28 to be displaced into and from the volume 36 of the coil 35.

The layer of spacer fabric 29 is similar to the layer of spacer fabric 9 used in the mattress carrier 1 and can be provided with or without stitching. This layer of spacer fabric is for example obtainable under the tradename of Pressless®, from the company Bodet & Horst GmbH, in Germany.

Although a single layer of spacer fabric is sufficient for the invention, a combination of two or more distinct layers 32, 33 one of which is a layer of spacer fabric 29, substantially extending over the entire resting surface of the mattress can be used. Although not critical for the invention, by extending over substantially the entire resting surface, the improved aeration and support capabilities of the mattress 28 are maximized.

The upper layer 32 preferably is a first support layer of soft material. The upper layer 32 preferably consists of viscoelastic foam with an open cell structure, for example Eucatherm C®, Type TC50W, obtainable from the company Eupenfoam in Eupen, Belgium. However, the upper layer 32 can comprise any other soft material known to the person skilled in the art, such as other visco-elastic foamed material known to the person skilled in the art and/or other foam with an open cell structure.

The lower layer 33 preferably comprises a layer of spacer fabric 29 and preferably has a thickness of 40 mm.

Preferably, the mattress 28 is provided with a second support layer 34 of second soft material. This layer 34 preferably also extends over a substantial part of the resting surface of the mattress 28. More preferably the second support layer 34 of soft material is provided below the combination of the first support layer of soft material 32 and the lower layer 33 of spacer fabric 29.

The second support layer 34 of soft material preferably consists of viscoelastic foam with an open cell structure, for example Eucatherm C®, Type TC50W, obtainable from the company Eupenfoam in Eupen, Belgium. However, the upper layer 32 can comprise any other soft material known to the person skilled in the art, such as other visco-elastic foamed material known to the person skilled in the art and/or other foam with an open cell structure.

Preferably, the reversible compressible material of the respective mattress carrier 1 and mattress 28 are located with respect to each other so that the aeration of the assembly is improved, more preferably, substantially adjacent to each other.

Preferably, a substantial part of the combined height of the assembly according to the invention is formed of the reversible compressible material so as to maximize the aeration offered by the assembly according to the invention.

Moreover, when used in combination with an assembly comprising a heater, the warmth can rise up more easily through the assembly to the resting surface due to for example convection so that the use of a ventilator can be avoided.

The inventor has also found that the different adjacent layers of reversibly compressible material form a volume through which air can circulate which increases the abduction of humidity, passage of air, etc. adding to the comfort of the assembly for a person occupying the mattress 28. The circulation of air is increased when a heater is provided.

The invention claimed is:

1. A mattress carrier (1) comprising a first part (3) which comprises a support surface (2) for supporting a mattress which is positioned on top of the support surface (2) and a second part (4) supporting the first part (3), the first part (3) being resilient in height direction and partially compressible when subjected to a load, characterised in that the first part (3) comprises a resilient insert (11) and in that the resilient insert (11) comprises a reversibly compressible substantially diamagnetic material which is substantially air-permeable, wherein the resilient insert (11) comprises at least one layer (18) of reversibly compressible spacer fabric (9) extending along at least part of a length, width and height of the first part (3), the at least one layer (18) of spacer fabric (9) comprising at least two spaced apart planes (16, 17) of fabric held together by a plurality of flexible fibres (8) extending between the spaced apart planes (16, 17) of fabric.

2. Assembly of a mattress carrier (1) according to claim 1 and a mattress (28) delimited by an upper wall (30) providing a resting surface, a lower wall (31) providing a support surface supported by the support surface (2) of the mattress carrier (1) and a plurality of side walls, the mattress (28), at least over part of its resting surface, comprising a reversibly compressible substantially diamagnetic material which is substantially air-permeable.

3. A mattress carrier (1) according to claim 1, characterised in that at least one of the spaced apart planes (16, 17) of fabric of the at least one layer (18) of spacer fabric (9) runs substantially parallel to the support surface (2) and in that the fibres (8) extend in height direction of the mattress carrier (1).

4. A mattress carrier (1) according to claim 1, characterised in that the resilient insert (11) comprises at least two layers (18, 19) of spacer fabric (9) positioned on top of each other.

5. A mattress carrier (1) according to claim 1, characterised in that the resilient insert (11) comprises at least two layers (11, 12) of spacer fabric (9) adjoining in length direction of the first part (3).

6. A mattress carrier (1) according to claim 1, characterised in that the resilient insert (11) comprises at least two layers (14, 15) of spacer fabric (9) adjoining in width direction of the first part (3).

7. A mattress carrier (1) according to claim 1, characterised in that the resilient insert (11) comprises a coil (35) of a plastic material, which coil (35) comprises a volume (36) delimited by a wall, wherein the wall extends mainly in height direction of the mattress carrier (1) and comprises a plurality of piled and mutually connected bulges (37), at least one of the bulges (37) comprising an outlet (38) to permit air contained in the mattress carrier (1) to be displaced into and from the volume of the coil (35).

8. A mattress carrier (1) according to claim 1, characterised in that the resilient insert (11) is removably mounted within the first part (3).

9. A mattress carrier (1) according to claim 1, characterised in that the first part (3) comprises at least two zones (21, 22) in length direction of the first part (3), the zones (21, 22) being subjected to the load of different parts of the body of a person occupying the mattress, each zone (21, 22) having different resilient properties and offering a different support and at least one zone (21, 22) comprising at least one insert (11, 12).

10. A mattress carrier (1) according to claim 9, characterised in that the first part (3) comprises at least three zones (21, 22, 23) in length direction of the first part (3), a first zone (21) being subjected to the load of the head and shoulder part of the person occupying the mattress, the second zone (22) being subjected to the load of the hip and back part of the person occupying the mattress, a third zone (23) being subjected to the load of the leg part of the person occupying the mattress, each zone (21, 22, 23) having a different resilient properties.

11. A mattress carrier (1) according to claim 1, characterised in that the first part (3) comprises at least two zones (24, 25) in the width direction of the first part (3), each zone (24, 25) being subjected to the load of a different person occupying the mattress, each zone (24, 25) having different resilient properties and offering a different support and at least one zone (24, 25) comprising at least one insert (14, 15).

12. A mattress carrier (1) according to claim 1, characterised in that the first part (3) comprises a resilient material (7) at least partially surrounding the resilient insert (11).

13. A mattress carrier (1) according to claim 12, characterised in that the resilient material (7) comprises foamed rubber.

14. A mattress carrier (1) according to claim 1, characterised in that at least one edge (26) surrounding the first part (3) is elevated with respect to a central part (27) of the first part (3).

15. A mattress carrier (1) according to claim 1, characterised in that the second part (4) comprises a perforated board (6) supporting the first part (3).

16. A mattress carrier (1) according to claim 1, characterised in that the mattress carrier (1) comprises a heater for providing warm air from beneath the support surface (2) to at least part of the support surface (2).

17. Assembly according to claim 2, characterised in that the mattress (28) comprises a coil (35) of a plastic material, which coil (35) comprises a volume (36) delimited by a wall, wherein the wall extends mainly in height direction of the mattress (28) and comprises a plurality of piled and mutually connected bulges (37), at least one of the bulges (37) comprising an outlet (38) to permit air contained in the mattress (28) to be displaced into and from the volume (36) of the coil (35).

18. Assembly according to claim 2, characterised in that the mattress (28) comprises a layer of spacer fabric (29).

19. Assembly according to claim 18, characterised in that the mattress (28) comprises a combination of two distinct layers (32, 33), superimposed in the thickness direction of the mattress (28), whereby the upper layer (32) of the combination is a first support layer of first soft material, and the lower layer (33) of the combination is the layer of spacer fabric (29).

20. Assembly according to claim 19, characterised in that the soft material is a viscoelastic foamed material.

21. Assembly according to claim 19, characterised in that it moreover comprises a second support layer (34) of second soft material, extending at least over part of its resting surface and directly below the combination.

22. Assembly according to claim 21, characterised in that it comprises, extending substantially over its whole resting surface, said combination of two distinct layers (32, 33) positioned on top of said second support layer (34) of second soft material.

23. Assembly of a mattress carrier (1) and a mattress (28), the master carrier comprising a first part (3) which comprises a support surface (2) for supporting a mattress which is positioned on top of the support surface (2) and a second part (4) supporting the first part (3), the first part (3) being resilient in height direction and partially compressible when subjected to a load, characterised in that the first part (3) comprises a resilient insert (11) and in that the resilient insert (11) comprises a reversibly compressible substantially diamagnetic material which is substantially air-permeable, and the mattress (28) delimited by an upper wall (30) providing a resting surface, a lower wall (31) providing a support surface supported by the support surface (2) of the mattress carrier (1) and a plurality of side walls, the mattress (28), at least over part of its resting surface, comprising a reversibly compressible substantially diamagnetic material which is substantially air-permeable, wherein the mattress (28) comprises a layer of space fabric (29).

24. Assembly according to claim 19, characterised in that the soft material is a foam with an open cell structure.

25. Assembly according to claim 24, characterised in that the soft material is a reticulated foam material.

26. A mattress carrier (1) comprising a first part (3) which comprises a support surface (2) for supporting a mattress which is positioned on top of the support surface (2) and a second part (4) supporting the first part (3), the first part (3) being resilient in height direction and partially compressible when subjected to a load, characterised in that the first part (3) comprises a resilient insert (11) and in that the resilient insert (11) comprises a reversibly compressible substantially diamagnetic material which is substantially air-permeable, wherein the resilient insert (11) comprises a coil (35) of a plastic material, which coil (35) comprises a volume (36) delimited by a wall, wherein the wall extends mainly in height direction of the mattress carrier (1) and comprises a plurality of piled and mutually connected bulges (37), at least one of the bulges (37) comprising an outlet (38) to permit air contained in the mattress carrier (1) to be displaced into and from the volume of the coil (35).

27. Assembly of a mattress carrier (1) and a mattress (28), the master carrier comprising a first part (3) which comprises a support surface (2) for supporting a mattress which is positioned on top of the support surface (2) and a second part (4) supporting the first part (3), the first part (3) being resilient in height direction and partially compressible when subjected to a load, characterised in that the first part (3) comprises a resilient insert (11) and in that the resilient insert (11) comprises a reversibly compressible substantially diamagnetic material which is substantially air-permeable, and the mattress (28) delimited by an upper wall (30) providing a resting surface, a lower wall (31) providing a support surface supported by the support surface (2) of the mattress carrier (1) and a plurality of side walls, the mattress (28), at least over part of its resting surface, comprising a reversibly compressible substantially diamagnetic material which is substantially air- permeable, wherein the mattress (28) comprises a coil (35) of a plastic material, which coil (35) comprises a volume (36) delimited by a wall, wherein the wall extends mainly in height direction of the mattress (28) and comprises a plurality of piled and mutually connected bulges (37), at least one of the bulges (37) comprising an outlet (38) to permit air contained in the mattress (28) to be displaced into and from the volume (36) of the coil (35).

* * * * *